US006086692A

United States Patent [19]

Hawkins et al.

[11] Patent Number: 6,086,692

[45] Date of Patent: Jul. 11, 2000

[54] ADVANCED DESIGNS FOR HIGH PRESSURE, HIGH PERFORMANCE SOLID PROPELLANT ROCKET MOTORS

[75] Inventors: David K. Hawkins, Brigham City; Carol J. Campbell, Farr West, both of Utah

[73] Assignee: Cordant Technologies, Inc., Salt Lake City, Utah

[21] Appl. No.: 09/165,304

[22] Filed: Oct. 2, 1998

Related U.S. Application Data

[60] Provisional application No. 60/060,789, Oct. 3, 1997.

[51] Int. Cl.[7] ..... C06B 45/10; C06B 45/08

[52] U.S. Cl. ..... 149/19.9; 149/19.2; 149/19.4; 149/19.5; 149/20

[58] Field of Search ..... 149/19.1, 19.2, 149/19.3, 19.4, 19.5, 19.6, 19.7, 19.8, 19.9, 19.91, 19.92, 19.93, 20, 21; 60/253, 255

[56] References Cited

U.S. PATENT DOCUMENTS

| | | | |
|---|---|---|---|
| 3,171,870 | 3/1965 | Monteil et al. | 264/3 |
| 3,390,027 | 6/1968 | Olberg et al. | 149/19 |
| 3,677,010 | 7/1972 | Fink et al. | 60/220 |
| 3,986,910 | 10/1976 | McCulloch | 149/19.9 |
| 4,099,376 | 7/1978 | Japs | 60/253 |
| 4,318,760 | 3/1982 | Stephens et al. | 149/19.2 |
| 4,391,660 | 7/1983 | Corley | 149/19.9 |
| 4,776,993 | 10/1988 | Chang | 263/3.3 |
| 5,074,938 | 12/1991 | Chi | 149/21 |
| 5,334,270 | 8/1994 | Taylor, Jr. | 149/19.4 |
| 5,348,596 | 9/1994 | Goleniewski et al. | 149/19.6 |
| 5,468,312 | 11/1995 | Martin et al. | 149/19.4 |
| 5,472,532 | 12/1995 | Wallace, II | 149/17.4 |
| 5,579,634 | 12/1996 | Taylor, Jr. | 60/219 |
| 5,771,679 | 6/1998 | Taylor, Jr. et al. | 60/219 |

FOREIGN PATENT DOCUMENTS

| | | |
|---|---|---|
| 2 232 523 | 1/1975 | France . |
| 27 18 013 | 11/1977 | Germany . |
| 1 300 381 | 12/1972 | United Kingdom . |
| 2 200 903 | 8/1988 | United Kingdom . |

OTHER PUBLICATIONS

J. Mamie, Schweizerische Technische Zeitschrift, XP–002096765, STZ No. 44, Nov. 4, 1965, pp. 889–896.

6001 Chemical Abstracts, XP–000156193, Nov. 13, 1989, No. 20, 111, p. 202.

6001 Chemical Abstracts, XP–000188157, Jan. 28, 1991, No. 4, 114, p. 153.

6001 Chemical Abstracts, XP–000789751, Sep. 21, 1998, No. 12, 129, p. 695.

*Primary Examiner*—Charles T. Jordan
*Assistant Examiner*—Aileen J. Baker
*Attorney, Agent, or Firm*—Intellectual Property Group Pillsbury Madison & Sutro LLP

[57] ABSTRACT

A solid rocket propellant formulation with a burn rate slope of less than about 0.15 ips/psi over a substantial portion of a pressure range of about 1,000 psi to about 7,000 psi and a temperature sensitivity of less than about 0.15%/° F. is provided. A high performance solid propellant rocket motor including the solid rocket propellant formulation is also provided. The rocket motor is encased in a high strength low weight motor casing which is further equipped with a nozzle throat constructed of material that has an erosion rate not more than about 2 to about 3 mils per second during motor operation. The solid rocket propellant formulation can be cast in a grain pattern such that an all-boost thrust profile is achieved.

14 Claims, 5 Drawing Sheets

ADVANCED DESIGNS FOR HIGH PRESSURE, HIGH PERFORMANCE SOLID PROPELLANT ROCKET MOTORS

This application claims priority from U.S. Provisional Application No. 60/060,789 filed on Oct. 3, 1997, the complete disclosure of which is hereby incorporated by reference.

BACKGROUND OF THE INVENTION

1. Field of the Invention

This invention relates to high performance tactical rocket motors and solid propellant formulations operable at high pressures with burn rates relatively insensitive to changes in pressure and propellant temperature. More particularly, this invention relates to propulsion vehicles including the high performance propellant formulations in a high strength, low inert weight casing equipped with an erosion-resistant nozzle throat.

2. Description of the Related Art

Conventional solid propellant rocket motors operate by generating large amounts of hot gases from the combustion of a solid propellant formulation stored in the motor casing. The solid propellant formulation generally comprises an oxidizing agent, a fuel, and a binder. During operation, the gases generated from the combustion of the solid propellant accumulate within the combustion chamber until enough pressure is amassed within the casing to force the gases out of the casing and through an exhaust port. The expulsion of the gases from the rocket motor and into the environment produces thrust.

Thrust is measured as the product of the total mass flow rate of the combustion products exiting the rocket multiplied by the velocity of the exiting combustion products plus the product of the change in pressure at the exit plane multiplied by the exit area.

Increasing the pressure at which the gases are expelled from the combustion chamber raises the thrust level, which in turn increases the propulsion rate of the vehicle containing the rocket motor to thereby permit the vehicle to achieve higher speeds.

Since pressure is a measurement of force per unit exit area, it follows that the gas expulsion pressure can be increased by decreasing the diameter of the rocket motor nozzle throat through which the combustion products are expelled.

Decreasing the diameter of the nozzle throat can also increase the expansion ratio of the throat. Expansion ratio is the ratio of the area of the nozzle exit located aft of the nozzle throat to the area of the nozzle throat. Conventional tactical rocket motors have expansion ratios in the range of 6 to 9. Increased expansion ratios result in higher levels of rocket performance.

With conventional solid rocket propellant formulations, as the operating pressure increases by decreasing the diameter of the nozzle throat, for example, the burn rate of the propellant also increases. The change in burn rate ($R_b$) as a function of the pressure change is defined as the burn rate slope, n:

$$\text{Burn rate slope} = \frac{\Delta \log \text{burn rate}}{\Delta \log \text{pressure}}$$

Data for determining burn rates at different pressures are typically gathered either by standard strand testing or by test motor analysis. The determination of burn rates by such testing procedures is well known in the art. Generally, conventional solid rocket propellant formulations have burn rate slopes of 0.15 ips/psi or greater.

Propellants which exhibit generally flat regions in their pressure versus burn rate curves are known as plateau propellants. Plateau propellants have generally flat regions over an operating range of at least 1,000 psi. Conventional propellants usually exhibit a dramatic positive increase in burn rate slope at pressures above about 3,000 psi, as shown in FIG. 1.

One of the problems associated with conventional propellant formulations having an exponentially increasing propellant burn rate is that an increase consumption of propellant generally increases the operating pressure, which in turn increases the risk of catastrophic failure of the rocket motor casing.

The conventional solution to avoiding catastrophic failure of the rocket motor casing is to strengthen the rocket motor casing by constructing the casings with thick walls from strong, dense materials, such as steel. This approach, however, deleteriously imparts a severe weight penalty to the vehicle. Consequently, a greater amount of thrust and an increased propellant burn rate is required to propel the vehicle at a comparable rate.

Another problem associated with the use of conventional solid propellant formulations is that the burn rate of such formulations varies in response to changes in the temperature of the propellant at ignition. Temperature sensitivity, $\pi_k$, is a measure of the sensitivity of the motor pressure to changes in propellant bulk temperature at ignition. $\pi_k$ is defined as:

$$\pi_k = \frac{\Delta \log \text{motor pressure}}{\Delta \log {}^\circ \text{F.}}$$

Motor and strand testing at various temperatures and pressures generate the data required to determine $\pi_k$. A typical nominal ignition temperature is in the range of 70° F. to 80° F.; temperature sensitivity is usually measured over a range of −65° F. to 160° F. The effect of temperature sensitivity on rocket performance is shown in FIG. 2. Conventional propellants have temperature sensitivities in the range of 0.15%/° F. or higher.

Typical rocket motors utilize nozzle throat materials that exhibit erosion during operation. These materials are selected primarily for their low cost, rather than high performance characteristics. At lower nominal operating pressure, such as those in existing tactical missiles, the rate of erosion of the nozzle throat does not result in a large performance loss. However, at operating pressures of 3000 psi and higher, use of existing nozzle throat materials results in substantially higher rates of erosion of the nozzle throat. Studies have shown that nozzle throat erosion is one of the most significant sources of performance loss, and that, not surprisingly, the magnitude of this loss increases as motor operating pressure and temperature increases. Moreover, the continuous erosion of the nozzle adds an element of unpredictability to the performance of the rocket motor.

An erosion-resistant nozzle throat material would allow high pressure motor operation at maximum performance efficiency without the expected performance limitations. Erosion-resistant materials should preferably have high melting points, and should be chemically inert to oxidizing gases or form an oxide that will reduce or inhibit further chemical erosion. Additionally, these materials must be capable of withstanding thermal shock and thermal stress and resisting extrusion. Although there have been motors developed that use non-eroding throat materials, such as tungsten, such non-eroding throats have generally been rejected in commercial use due to their relatively high expense and weight.

Most small diameter, for example, up to about 15 inches, tactical rocket motors comprise moderate to high strength steel cases. Air frame stiffness requirements of and the high operating pressures encountered during use of conventional solid propellants have driven the selection of high strength steel cases. In IM (insensitive munitions) testing, many of these steel case systems perform quite poorly, particularly when coupled with conventional HTPB/AP (hydroxy-terminated polybutadiene/ammonium perchlorate) propellants. Further, as described above, the overall weight of the solid propellant rocket motor propelled vehicle is a concern and increasing the weight of the motor case has an adverse impact on performance of the vehicle. Both lighter aluminum and titanium alloys have been investigated as possible materials for tactical motor casings above 5" diameter but have proven unsatisfactory for either effectiveness or cost reasons. There is a need for a rocket motor case optimally designed and composed of materials suitable for use with high pressure rocket motors and which fulfill the requirements for air frame stiffness, maximum motor operating pressure and IM testing.

The design and geometry of propellant grain also effect the performance characteristics of solid propellant rocket motors. Many existing tactical missile rocket motors use a boost-sustain thrust profile which starts at a high thrust level for generating large amounts of thrust necessary for lift-off or deployment, and subsequently decreases to a lower thrust to allow for a lower in-flight motor operating pressure. Thus, propellant grain designs should be capable of being tailored to achieve a thrust profile that maintains high thrust and motor pressure conditions throughout the course of flight.

It would be a significant advancement in the art to provide a solid rocket propellant formulation operable at high pressures without a high positive burn rate slope or high temperature sensitivity. A low or negative burn rate slope and low temperature sensitivity would result in propellant burn rates that are insensitive to increases in operating pressure and changes in propellant temperature and thus the propellant would operate at high pressures within a narrower, more predictable pressure range without an associated increase in propellant burn rate. Such a propellant would result in a more predictable and reliable operation of the rocket motor and vehicle.

SUMMARY OF THE INVENTION

It is an object of the present invention to overcome the foregoing problems and achieve the above advancement by providing a solid rocket propellant formulation having both a substantially insensitive burn rate over a substantial portion of a pressure range of from about 1,000 psi to about 7,000 psi, and a low temperature sensitivity.

Substantially insensitive burn rate means a burn rate slope of less than about 0.15 ips/psi. A substantial portion of the pressure range of from about 1,000 psi to about 7,000 psi is preferably a portion covering at least about 700 psi, and preferably 1000 psi. A low temperature sensitivity means a temperature sensitivity of less than about 0.15%/° F.

In accordance with one embodiment of this invention, these and other objects are achieved by providing a solid propellant formulation comprising at least one oxidizer, at least one polymeric binder, and at least one member selected from the group consisting of a co-oxidizer, a ballistic additive, and a polyisocyanate curative. The solid propellant formulation is designed to exhibit a burn rate slope of less than 0.15 ips/psi extending over at least a substantial portion of a pressure range between 1,000 psi and 7,000 psi, the burn rate slope being equal to:

$$\frac{\Delta \text{ log burn rate}}{\Delta \text{ log pressure}}.$$

The combination of the solid propellant formulation, non-eroding nozzle throat material, high strength low weight rocket motor casing, and all-boost thrust profile has been shown to provide as much as a 300% increase in missile trajectory over conventional technologies. The combination results in rocket motors with expansion ratios of up to 17, a significant improvement over conventional technologies using an eroding nozzle throat material, heavy rocket motor casing, and boost-sustain thrust profile. It is through the synergistic effect of the technologies that the above-noted 300% increase is achieved.

These and other objects, features and advantages of the present invention will become apparent from the following detailed description of the invention when taken in conjunction with the accompanying figures which illustrate, by way of example, the principles of the present invention.

DETAILED DESCRIPTION OF THE INVENTION

The maximum pressure under nominal operating conditions produced by the solid propellant, Pmax, is one parameter that effects numerous design aspects of rocket propelled vehicles. Another important design parameter is the maximum expected operating pressure (MEOP). Off-nominal operating conditions such as higher operating temperatures, manufacturing variations in propellant geometry, flaws in motor construction, variation in nozzle erosion rate, and variation in propellant burn rate with temperature influence the MEOP causing it to be greater than Pmax.

It is highly desirable, from a vehicle design viewpoint, to have the margin between MEOP and Pmax as small as possible. Nonetheless the vehicle, particularly the rocket motor casing, preferably is designed to function safely at MEOP, not merely Pmax. Therefore, a large margin between MEOP and the Pmax can result in, for example, a vehicle and rocket motor casing being significantly over-designed in order to meet MEOP levels. This over-design can result in increased inert weight from the use of, for example, a rocket motor casing designed to MEOP levels which are greatly above Pmax levels. The propellant formulations of the present invention have relatively small burn rate slopes and low temperature sensitivities, thereby permitting a lower margin between MEOP and Pmax to be achieved. Preferably, the burn rate slopes are less than about 0.15 ips/psi, more preferably, in a range of less than about 0.15 to about zero ips/psi, and most preferably, about zero to less than zero ips/psi.

The effect of the burn rate slope of the propellant on the MEOP can be determined in the following fashion. The pressure generated by the propellant is roughly a function of propellant burning surface area (As), nozzle throat area (At), and the propellant burn rate slope (n) so that under nominal operation the following relationship exists:

$$Pmax/Pavg = \frac{(Asmax\,Atavg)}{(Atmax\,Asavg)} * (Pmax/Pavg)^n \quad (1)$$

wherein,

P=chamber pressure

Asmax=propellant burning surface area at Pmax

Asavg=propellant burning surface area at Pavg n=propellant burn rate slope

Atmax=nozzle throat area at Pmax

Atavg=nozzle throat area at Pavg.

Under nominal conditions, the maximum and average pressures will be effected directly by changes in the propellant surface area and changes in the nozzle throat area and exponentially by the propellant burn rate slope.

Further simplifying equation (1), by combining the pressure change drivers, As and At into Z, wherein $Z_x$ equals $As_x/At_x$, yields:

$$Pmax/Pavg=Zmax/Zavg\ (Pmax/Pavg)^n \quad (2)$$

Figure 1:
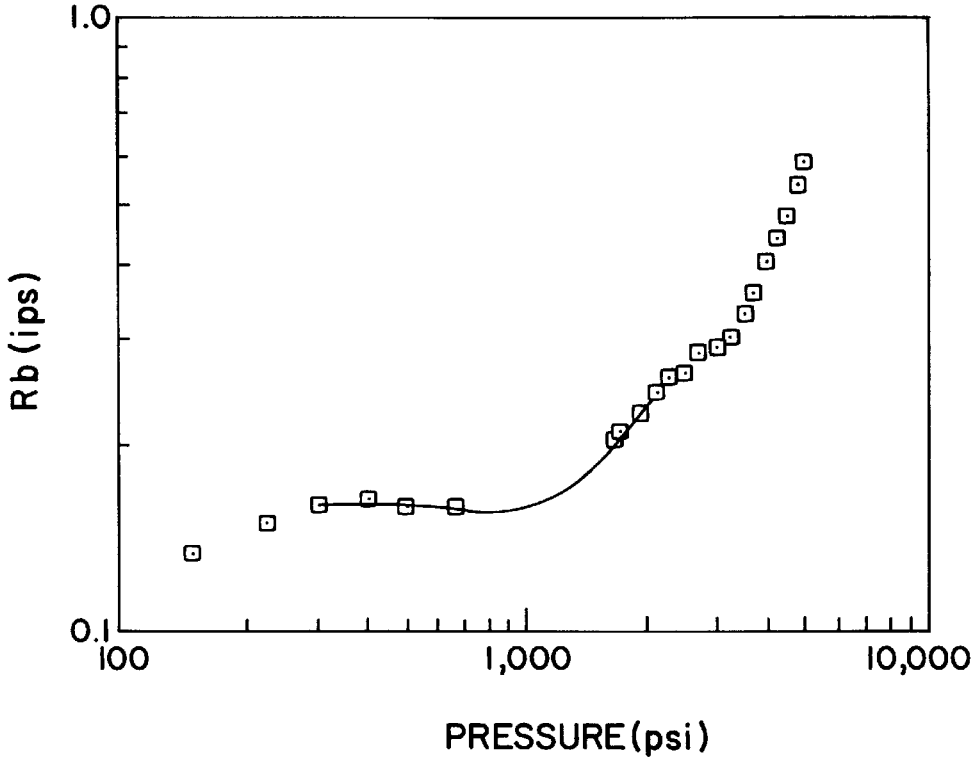
FIG. 1 (PRIOR ART)
FIG. 1 is a pressure versus burn rate plot for a conventional solid rocket plateau propellant formulation.
Figure 2:
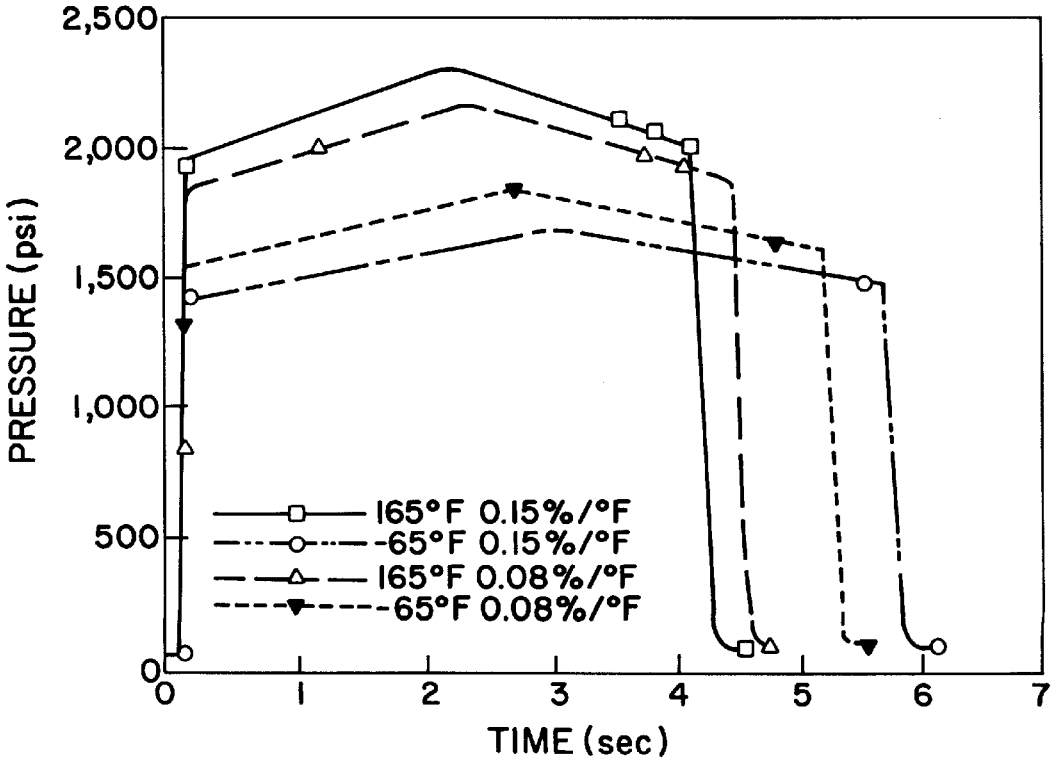
FIG. 2 (PRIOR ART)
FIG. 2 is a time versus pressure plot illustrating the effect of temperature sensitivity on motor performance.
Figure 3:
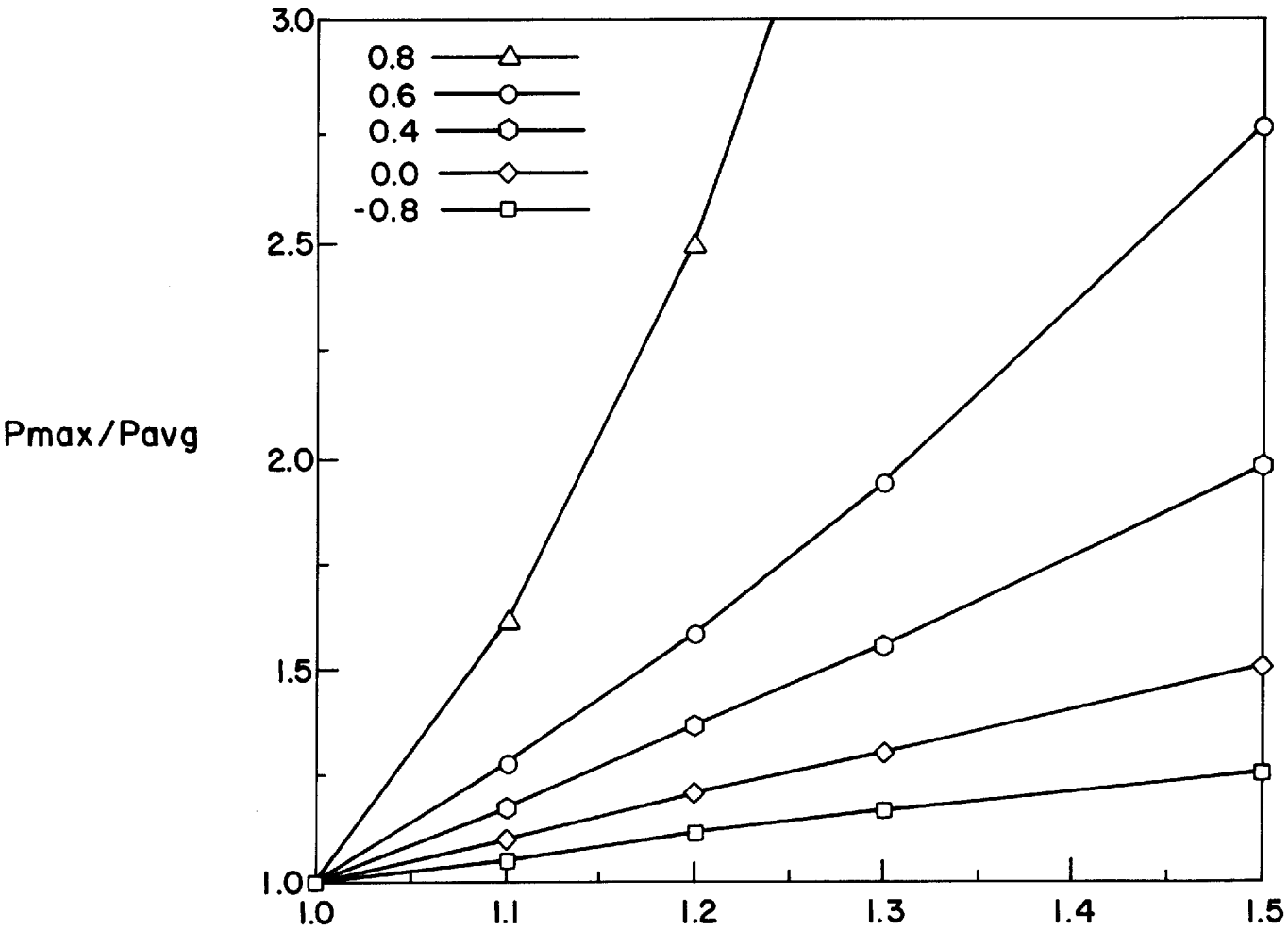
FIG. 3 is a plot of the effect of burn rate slope on nominal maximum pressure.

Equation 2 is plotted in FIG. 3 for a range of Zmax/Zavg values over several burn rate slope values.

If Zmax/Zavg is equal to 1.0 (that is, either the burning surface area and the nozzle throat area do not change, or the changes compensate for each other), then the burn rate slope does not influence the Pmax/Pavg. However, in most practical situations, Zmax/Zavg will have a value greater than 1.0, and the burn rate slope will have a significant effect on Pmax/Pavg, as shown in FIG. 3.

Conventional solid propellant formulations have positive burn rate slopes and thus Pmax/Pavg will be greater than Zmax/Zavg. Propellants according to the present invention have small or negative burn rate slopes and thus Pmax/Pavg is only slightly greater then Zmax/Zavg, or even smaller than Zmax/Zavg, if the burn rate slope is negative.

The measurement of burn rates at various pressures for a given propellant formulation is accomplished by well known test methods, such as, for example, strand and/or test motor evaluations.

The propellants, according to the present invention, which exhibit small or negative burn rate slopes, provide increased options in the design of rocket motors and vehicles. These options include 1) operating at higher Pavg for the same Pmax, 2) lowering Pmax for the same Pavg, 3) increasing Zmax/Zavg for the same Pmax/Pavg, and 4) combinations of the above. All of the options can lead to higher performance rocket motors and vehicles.

The effect of propellant temperature sensitivity on MEOP is utilized in the design of rocket motors and rocket propelled vehicles and can be calculated by the following equation:

$$P_T=e^{\pi k(Thot-Tnom)}$$

wherein, $P_T$=Increase in MEOP due to temperature change

Thot=Maximum expected initial propellant temperature

Tnom=Nominal initial propellant temperature.

Assuming a nominal initial propellant temperature of 70° F., a maximum expected initial propellant temperature of 165° F., and a conventional propellant temperature sensitivity of 0.15%/° F. would result in a $P_T$ of 1.10, or a 10% increase in MEOP. Utilizing an exemplary propellant according to the present invention, with a $\pi_k$ value of 0.038%/° F., the same temperature change would result in a $P_T$ of 1.037, or for this example, a 6.3% smaller increase in MEOP from the temperature change as compared to the conventional propellant.

Figure 4:
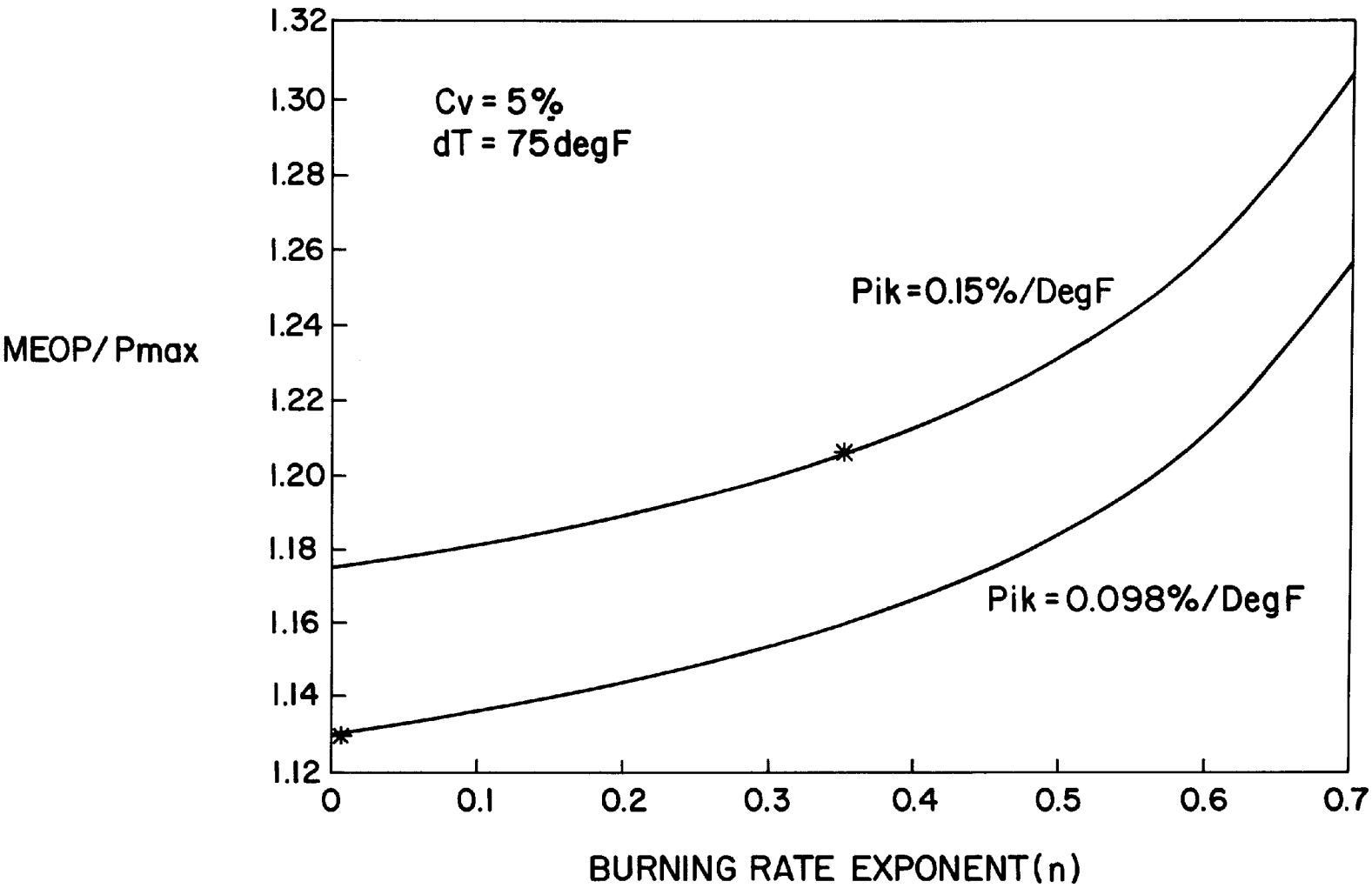
FIG. 4 is a plot of the combined effects of $\pi_k$ and burn rate slope on the ratio MEOP:Pmax.

The combined effect of changes in burn rate slope and temperature sensitivity of a propellant formulation on the resulting ratio between MEOP and Pmax for a conventional propellant and a propellant according to the present invention are illustrated in FIG. 4. The ratio MEOP/Pmax represents the pressure margin required for off nominal high temperature performance at the worst expected condition (MEOP). FIG. 4 was generated for a 75° F. temperature increase and non-temperature pressure variabilities of 5%. At a given burn rate slope, the conventional propellant has a higher MEOP/Pmax ratio than the propellant according to the present invention.

A solid rocket propellant formulation, according to the present invention, is based on the use of a polyalkylene oxide (PAO) binder. An example of a PAO is a co-polymer of polyethylene glycol and polypropylene glycol. A variety of polyethers can be employed in this embodiment, with slightly different ballistic properties expected from the various polymers. The polyalkylene oxide polymer can be a random polyether co-polymer, or mixtures of polyether polymers. Suitable PAO binders have average molecular weights in the range of about 2,000 to 5,000 g/mol.

A solid rocket propellant formulation, according to an embodiment of the present invention, can be formulated from the following ingredients:

| Ingredient | Weight % (Approximate) |
|---|---|
| AP Oxidizer | |
| Total | 50–90 |
| Large Particle Size | 25–55 |
| Small Particle Size | 25–40 |
| PAO Polymeric Binder | 7–15 |
| Al Fuel | 0–25 |
| Ballistic Modifier | 1–4 |
| Plasticizer | 0–10 |
| Curative | 0.01–1 |
| Stabilizer | 0–1 |
| Cure Catalyst | 0–0.01 |
| Co-oxidizer | 0–15 |

Ammonium perchlorate (AP) is generally incorporated into the formulation in the manner known in the art and AP may be used in multiple particle sizes. In particular, the large particle size AP can have a particle size in the range of about 185–215 μm, preferably about 200 μm, or alternatively, in a range of about 385–415 μm, preferably , about 400 μm, while small particle size AP in the range of from 2 μm to less than about 50 μm is preferable.

"Reduced smoke" formulations can also include a stability additive, preferably zirconium carbide, preferably at about 1 wt. %, instead of Al fuel. Other suitable reduced smoke stability additives include carbon, aluminum, and aluminum oxide.

"Metallized" formulations include Al fuel, instead of the stability additive, preferably contain the fuel in a range of about 18–22 wt. %. The fuel can be comprised of aluminum metal with a particle size in the range of 100 to 130 $\mu$m, preferably about 117 $\mu$m. Other possible fuels include magnesium and boron.

A nitramine oxidizer, such as HMX, tetramethylene tetranitramine, an exemplary co-oxidizer, can be incorporated at about 2–15 wt. % to obtain the desired high pressure, low burn rate slope performance. Other suitable co-oxidizers include AN (ammonium nitrate), TEX (4,10-dinitro-2,6,8,12-tetraoxa-4,10-diazatetracyclo[$5.5.0.0^{5,9}.0^{3,11}$]dodecane), RDX (trimethylene trinitramine), and CL20 (2,4,6,8,10,12-hexanitro-2,4,6,8,10,12-hexaazatetracyclo[$5.5.0.0^{5,9}.0^{3,11}$] dodecane).

Suitable ballistic modifiers include refractory oxides, such as $TiO_2$, $ZrO_2$, $Al_2O_3$, and $SiO_2$ and similar materials. Excellent results have been achieved with both coarse (average size 0.5 $\mu$m) and fine (average size 0.02 $\mu$m) particle size refractory oxides and mixtures thereof. Suitable particle sizes range from about 0.01 to 2 $\mu$m. Preferably these refractory oxides are incorporated into the formulations in a range of about 1 to 3 wt. %, most preferably at about 2 wt. %. Of these materials, $TiO_2$ is preferred.

A suitable stabilizer is MNA (N-methyl-p-nitroaniline). Other suitable stabilizers for nitrate esters include 4-NDPA (4-nitrodiphenylamine), and other stabilizers well known in the art.

A curative can also be added to the formulation, and examples of suitable curatives include polyfunctional isocyanates, such as TMXDI (m-tetramethylxylene diisocyanate), DDI (dimeryl diisocyanate), IPDI (isophorone diisocyanate) and Desmodur N-100 (biuret triisocyanate) as commercially available from Mobay.

Suitable plasticizers include TEGDN, (triethyleneglycol dinitrate), or BuNENA, (n-butyl-2-nitratoethyl-nitramine) or mixtures of the two. Other suitable plasticizers include DEGDN (diethyleneglycol dinitrate), TMETN (trimethylolethane trinitrate), and BTTN (butanetriol trinitrate).

TPTC (triphenyltin chloride) is a suitable cure catalyst. Other suitable cure catalysts include TPB (triphenyl bismuth), dibutyltin diacetate, and dibutyltin dilaurate. These compounds and others may be used as needed to prepare a propellant formulation with the specific desired characteristics.

The various components of the propellant can be formulated and combined to form the solid propellant according to standard procedures as set forth, for example, in *Principles of Solid Propellant Development*, Adolf E. Oberth, CPIA Publication 469, September 1987, the complete disclosure of which is incorporated herein by reference.

The formulated solid propellant is housed within a rocket motor case housing, which housing comprises a rocket nozzle located at its aft end. The throat of the rocket nozzle preferably is constructed such that an erosion rate is no more than about 2 mils per second during motor operation.

Nozzle throat materials which exhibit acceptable non-erosive behavior may include metals and alloys of metals such as tungsten and rhenium; ceramic materials, such as hafnium carbide; or a deposition or coating of metals such as rhenium, tungsten, hafnium, for example, onto structural substrates.

Preferably, the non-eroding throat materials are extended some distance downstream of the nozzle throat into the exit cone thereby further preventing additional performance loss. Preferably, the application of these non-eroding materials is extended downstream into the exit cone of the nozzle to a point on the exit cone where the expansion ratio is between about 2 and 4. Preferably, the non-eroding materials erode, under high pressure, that is greater than 3000 psi, at a rate of no greater than about 2 to 3 mils per second.

Chemical vapor deposition (CVD) of refractory metals on graphite and thicker shells of refractory metals with PAN (polyacrylic nitrile) phenolic overwrap can also be utilized. Preferred refractory metals include rhenium and tungsten. Alloys of rhenium and tungsten can also be used, a preferred alloy is tungsten with 10% rhenium.

The present invention also encompasses high temperature monolithic and composite ceramics as non-eroding nozzle throat materials. Examples of such ceramic materials include $HfO_2W$, $HfB_2$, $ZrB_2$, HfC, TaC, and ZrC, particularly preferred are HfC, TaC, and $ZrB_2$.

Figure 5:
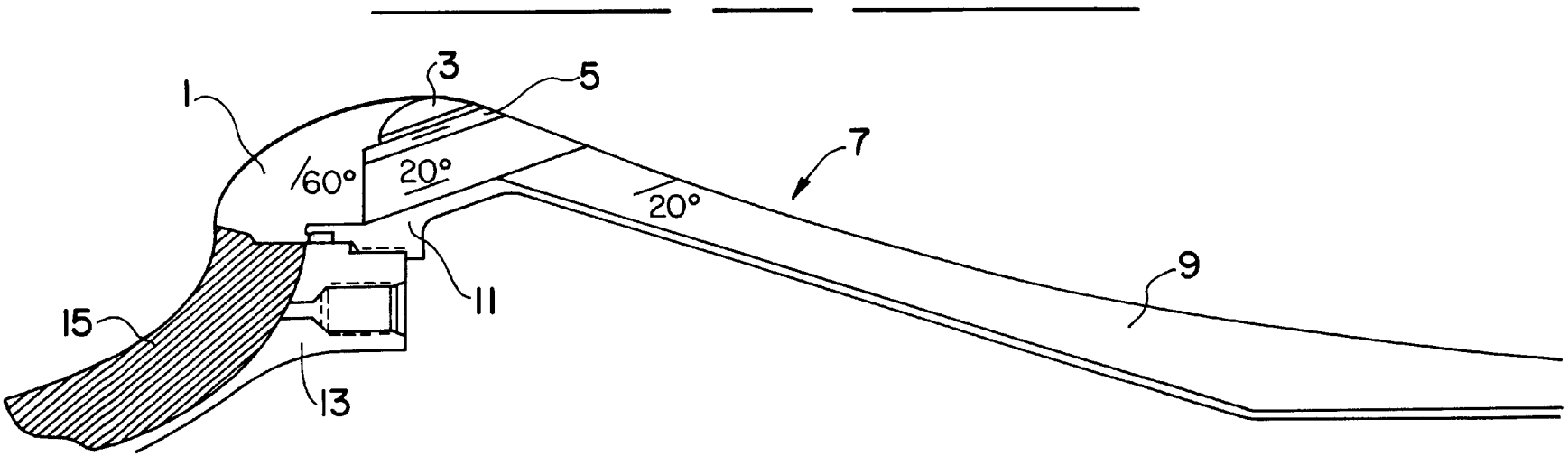
FIG. 5 is a sectional schematic view of a portion of a nozzle throat assembly utilizing non-eroding nozzle throat material.
Figure 6:
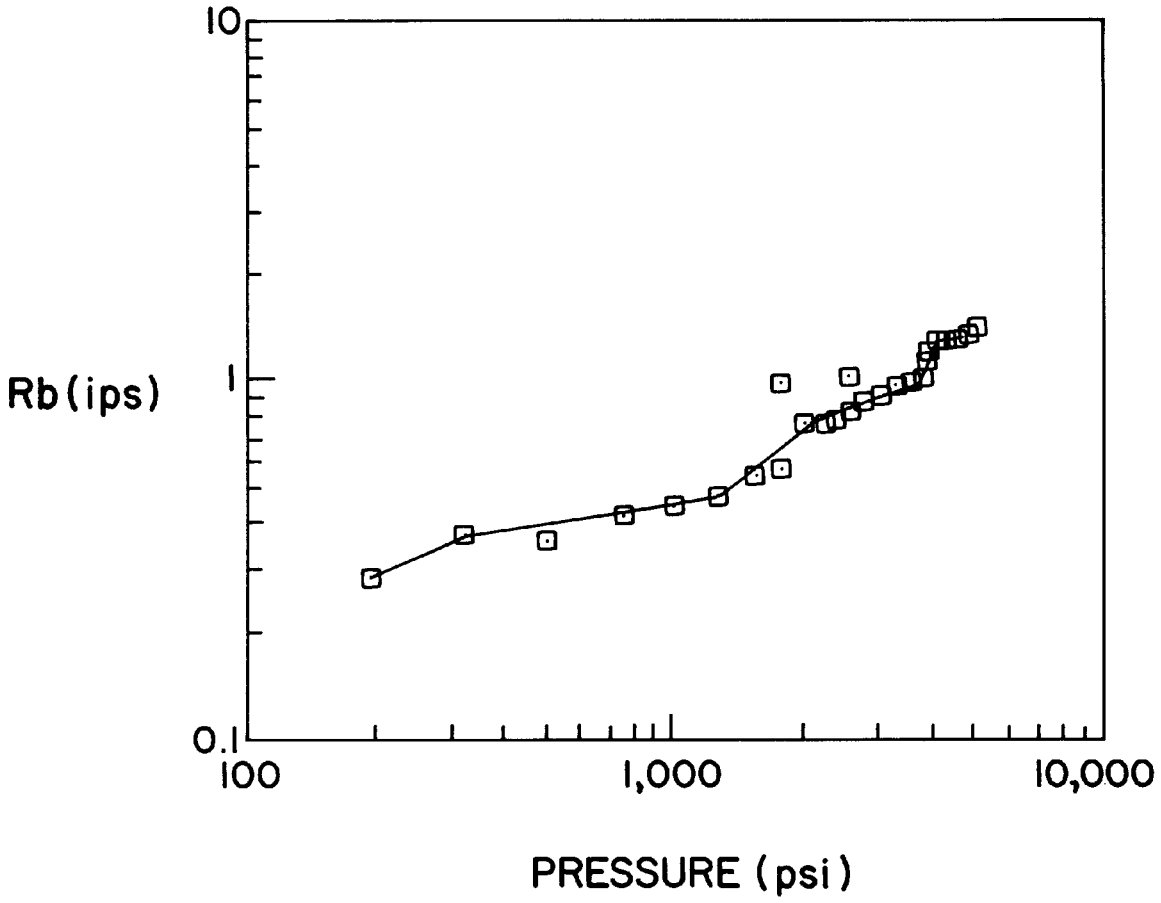
FIG. 6 is a pressure versus burn rate plot for a solid rocket propellant formulation according to the present invention.

An example of a rocket nozzle utilizing the nozzle throat materials according to the present invention is illustrated in FIG. 5. The rocket nozzle has an inlet 1 preferably composed of a molded silica phenolic material located above a closure 13 covered by insulation 15. The rocket nozzle throat features an insert 3 of CVD coated rhenium/carbon graphite supported by a carbon phenolic tape wrapped throat support 5. Silica phenolic tape is utilized for both throat insulation 7 and exit cone insulation 9. The nozzle shell 11 is composed of steel, preferably 4130 grade steel.

The solid propellant according to the present invention achieves improved performance by operating at higher than normal pressures with a low or negative burn rate slope. In order to maximize and take advantage of the performance increases resulting from the higher operating pressures, minimizing the motor case weight is highly desired. Although conventional motor case materials, such as steel, can be employed, in order to reduce inert weight, preferably low weight, high strength materials are utilized. Examples of such suitable low weight, high strength materials include graphite materials and composite materials. Suitable composite materials include carbon and graphite fibers and filaments which can be laminated with high temperature polymer resins such as bismaleimides, polyimides, epoxies, and PEEK (polyetheretherketone) thermoplastics.

High temperature performance of the composite materials is a key consideration in the selection of materials for use in rocket motor cases. The glass transition (Tg) temperature of the polymer resin largely determines the high temperature characteristics of the composite material. The temperature of the operational environment of a composite material should be at least 100° F. below Tg for long duration service and at least 50° F. below Tg for short duration service. Examples of suitable resin systems include epoxy (Fiberite 934 available from Fiberite), toughened epoxy (ERL 1908 available from Fiberite), amine toughened epoxy (Fiberite 974 available from Fiberite), bismaleimide (V388 available from Hitco), modified bismaleimide (Narmco 5245c and 5250 available from Cytek), and polyimide (PMR-15 available from US Poly).

Construction techniques which take advantage of the strength of the material and result in a finished case with improved strength also can be utilized. Of special concern, in utilization of the high strength graphite materials, is meeting case bending stiffness requirements while also providing for external missile attachments, such as launch lugs, fins and so forth. An exemplary case design according to the present invention utilizes high tensile strength graphite fibers for hoops and windings and high modulus graphite fibers for axial windings in a cross-ply arrangement to meet the above requirements. This design meets the bending stiffness requirements and still allows for higher pressure motor operation without excessive weight penalties.

The composite case according to the present invention must perform at higher stresses and at higher temperatures than past systems. These materials must have both high hoop strength and high axial stiffness throughout the operating temperature of the system.

A composite rocket motor case and methods for manufacturing are disclosed in U.S. Pat. Nos. 5,280,706 and 5,348,603, the complete disclosures of which are incorporated herein by reference.

Depending on the desired application, the performance of the solid propellant according to the present invention may be further maximized by the use of an all-boost propellant grain design. An all-boost propellant grain design features a grain geometry that results in a high thrust level throughout the entire burn period. This is in contrast to conventional tactical missile rocket motors which utilize a boost-sustain thrust profile which starts at a high thrust level but over time falls to a lower thrust level. The boost-sustain thrust profile limits the performance advantages achieved with the present invention.

An all-boost grain design can result in vehicle velocities exceeding the current state-of-the-art design parameters due to the resulting increased thermal stress. The increases in thermal stress can be reduced by using, for example, a pulse motor design wherein the thrust is divided into two or more pulses and the propellant grains are separated by a pressure bulkhead. When necessary to reduce the maximum mach number to within design parameters, the rocket motor can have a delay between the pulses to allow the missile velocity to decrease before firing the next impulse. Grain patterns that are known to those of skill in the art can be utilized to obtain the all-boost thrust profile.

It is possible by selection of varied formulation parameters to control the ballistic behavior of the propellant. The plateau regions and burn rates can be tailored via formula modification. Additionally, changes in selection of the curative and particle size of the ballistic modifier can produce plateaus at different burn rates and pressure regions.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1

A reduced smoke PAO propellant was prepared from the following formulation:

| Ingredient | Weight % |
|---|---|
| AP Oxidizer | |
| 200 μm | 44.08 |
| 2 μm | 31.92 |
| PAO | 10.478 |
| $TiO_2$, fine size | 2 |
| TEGDN | 7.718 |
| MNA | 0.25 |
| HMX (1.8 μm) | 3 |
| Desmodur N-100 | 0.548 |
| TPTC | 0.006 |

Performance testing was performed using strands of the formulation and the results are tabulated below:

| | |
|---|---|
| Plateau region | 4000–4700 psi |
| In plateau region | |
| Burn rate | 1.28–1.31 ips |
| Burn rate slope | 0.15 ips/psi |

Example 2

A metallized PAO propellant can be prepared by standard procedures and according to the following formulation:

| Ingredient | Weight % |
|---|---|
| AP Oxidizer | |
| 200 μm | 29 |
| 2 μm | 29 |
| Al fuel | 18 |
| PAO | 10.478 |
| $TiO_2$, fine size | 2 |
| TEGDN | 7.718 |
| MNA | 0.25 |
| HMX (1.8 μm) | 3 |
| Desmodur N-100 | 0.548 |
| TPTC | 0.006 |

Performance testing can be performed using strands of the formulation and the expected results are tabulated below:

| | |
|---|---|
| Plateau region | 4000–5000 psi |
| In plateau region | |
| Burn rate | 1.30–1.33 ips |
| Burn rate slope | 0.10 ips/psi |

Temperature Sensitivity Testing

The temperature sensitivity testing of Examples 1 and 2 would be expected to show both examples with $\pi_k$ values of 0.15%/° F. and lower.

The foregoing detailed description of the preferred embodiments of the invention has been provided for the purposes of illustration and description. It is not intended to be exhaustive or to limit the invention to the precise embodiments disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A solid propellant formulation comprising:

from about 25% to about 55% by weight ammonium perchlorate particles having an average size of about 200 μm;

from about 25% to about 40% by weight ammonium perchlorate particles having an average size in a range of from about 2 μm to about 50 μm;

from about 7% to about 15% by weight of at least one energetic polymeric binder, which further comprises a polymeric binder and an energetic plasticizer; and from about 1% to about 4% by weight of at least one ballistic modifier;

wherein said propellant formulation has a burn rate slope of less than about 0.15 ips/psi over a substantial portion of a pressure range of from about 1,000 psi to about 7,000 psi and a temperature sensitivity of less than about 0.15%/° F., wherein said burn rate slope is equal to:

$$\frac{\Delta \text{ log burn rate}}{\Delta \text{ log pressure}}.$$

2. A solid propellant formulation according to claim 1, wherein said polymeric binder is a polyalkylene oxide.

3. A solid propellant formulation according to claim 1, further comprising aluminum fuel.

4. A solid propellant formulation according to claim 1, further comprising at least one member selected from a plasticizer, a curative, a stabilizer, a cure catalyst, and a co-oxidizer.

5. A solid propellant formulation according to claim 1, wherein said ballistic modifier is titanium dioxide.

6. A solid propellant formulation according to claim 1, wherein said burn rate slope is between about 0 and about 0.15 ips/psi.

7. A solid propellant formulation according to claim 1, wherein said burn rate slope is less than about zero.

8. A solid propellant formulation comprising at least one oxidizer, at least one energetic polymeric binder, which further comprises a polymeric binder and an energetic plasticizer, and at least one ballistic modifier, said solid propellant formulation exhibits a burn rate slope of less than 0.15 ips/psi extending over at least a substantial portion of a pressure range between 1000 psi and 7000 psi, the burn rate slope being equal to:

$$\frac{\Delta \text{ log burn rate}}{\Delta \text{ log pressure}}.$$

9. A solid propellant formulation according to claim 8, wherein the burn rate slope is less than about zero.

10. A solid propellant formulation according to claim 8, wherein said solid propellant formulation has a temperature sensitivity of less than about 0.15%/° F. over a temperature range of about −65° F. to 160° F., and wherein said temperature sensitivity is a percentage change in burn rate of said solid propellant formulation per degree Fahrenheit change in propellant temperature at ignition.

11. A solid propellant formulation according to claim 8, wherein said oxidizer comprises:

from about 25% to about 55% by weight, based on the total weight of said solid propellant formulation, of ammonium perchlorate particles having a particle size of about 200 μm; and from about 25% to about 40% by weight, based on the total weight of said solid propellant formulation, of ammonium perchlorate having a particle size in a range of from about 2 μm to about 50 μm.

12. A solid propellant formulation according to claim 11, wherein said energetic polymeric binder comprises from about 7% to about 15% by weight, based on the total weight of said solid propellant formulation, of a polyalkylene oxide.

13. A solid propellant rocket motor comprising:

a solid propellant formulation according to claim 1;

said solid propellant formulation housed within a rocket motor case housing;

said rocket motor case housing comprising a rocket nozzle located at the aft end of said housing;

said rocket nozzle further comprising a nozzle throat; and said nozzle throat constructed such that an erosion rate is no more than about 2 mils per second during motor operation.

14. A solid propellant rocket motor comprising:

a solid propellant formulation according to claim 8;

said solid propellant formulation housed within a rocket motor case housing;

said rocket motor case housing comprising a rocket nozzle located at the aft end of said housing;

said rocket nozzle further comprising a nozzle throat; and said nozzle throat constructed such that an erosion rate is no more than about 2 mils per second during motor operation.

* * * * *